US011341910B2

(12) United States Patent
Shiau et al.

(10) Patent No.: US 11,341,910 B2
(45) Date of Patent: May 24, 2022

(54) PIXEL CIRCUIT AND DISPLAY OF LOW POWER CONSUMPTION

(71) Applicant: AU Optronics Corporation, Hsin-Chu (TW)

(72) Inventors: Kai-Wei Shiau, Hsin-Chu (TW); Chia-Yuan Yeh, Hsin-Chu (TW); Kuang-Hsiang Liu, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 17/171,778

(22) Filed: Feb. 9, 2021

(65) Prior Publication Data

US 2022/0051619 A1 Feb. 17, 2022

(30) Foreign Application Priority Data

Aug. 17, 2020 (TW) ..... 109127960

(51) Int. Cl.
*G09G 3/3233* (2016.01)

(52) U.S. Cl.
CPC ... *G09G 3/3233* (2013.01); *G09G 2300/0819* (2013.01); *G09G 2300/0842* (2013.01); *G09G 2300/0861* (2013.01); *G09G 2310/08* (2013.01); *G09G 2320/0233* (2013.01); *G09G 2320/045* (2013.01); *G09G 2330/021* (2013.01)

(58) Field of Classification Search
None
See application file for complete search history.

(56) References Cited

U.S. PATENT DOCUMENTS

| | | | | |
|---|---|---|---|---|
| 8,159,421 | B2 * | 4/2012 | Hwang | G09G 3/3233 345/82 |
| 8,624,806 | B2 | 1/2014 | Chung et al. | |
| 9,208,725 | B2 | 12/2015 | Guo et al. | |
| 9,343,014 | B2 * | 5/2016 | Huang | G09G 3/3233 |
| 9,728,133 | B2 | 8/2017 | Hu et al. | |
| 2015/0287361 | A1 * | 10/2015 | Lee | G09G 3/3233 315/172 |
| 2019/0051238 | A1 * | 2/2019 | Zhang | G09G 3/3258 |
| 2019/0066580 | A1 | 2/2019 | Xu | |
| 2021/0056895 | A1 * | 2/2021 | Lee | G09G 3/3233 |

* cited by examiner

*Primary Examiner* — Dorothy Harris
(74) *Attorney, Agent, or Firm* — WPAT, PC

(57) ABSTRACT

A pixel circuit of low power consumption is provided, which includes a first transistor for providing a driving current, a light emitting element, a light emitting control circuit, a reset circuit, a writing circuit, and a storage capacitor. The light emitting control circuit is coupled between the first transistor and the light emitting element, and is for selectively conducting the driving current to the light emitting element. The reset circuit is for providing a first reference voltage to the light emitting element by a first frequency. The storage capacitor is coupled between the writing circuit and the first transistor. The writing circuit is for providing, by a second frequency different from the first frequency, a data voltage and a second reference voltage to the storage capacitor and the first transistor, respectively. The storage capacitor is for storing a first voltage for compensating a threshold voltage of the first transistor.

18 Claims, 10 Drawing Sheets

100

PIXEL CIRCUIT AND DISPLAY OF LOW POWER CONSUMPTION

RELATED APPLICATIONS

This application claims priority to Taiwan Application Serial Number 109127960, filed on Aug. 17, 2020, which is herein incorporated by reference in its entirety.

BACKGROUND

Technical Field

The present disclosure relates to a pixel circuit and a display. More particularly, the present disclosure relates to a pixel circuit and a display of low power consumption.

Description of Related Art

Wearable devices such as smart watches and smart bracelets have developed rapidly in recent years, which include various sensors to measure parameters related to the environment or users. For example, a wearable device may include a three-axis accelerator and an optical heart rate sensor to track the user during fitness activities. A wearable device usually further includes a display to provide time or various measured parameters to the user. For the convenience of use, the user generally hopes that the display of the wearable device can be kept in the lit state for a long time period, which makes the display one of the most power-consuming components in the wearable device having limited power.

SUMMARY

The disclosure provides a pixel circuit of low power consumption, which includes a first transistor, a light emitting element, a light emitting control circuit, a reset circuit, a writing circuit, and a storage capacitor. The first transistor is configured to provide a driving current. The light emitting control circuit is coupled between the first transistor and the light emitting element, and is configured to selectively conduct the driving current to the light emitting element. The reset circuit is configured to provide a first reference voltage to the light emitting element by a first frequency. The storage capacitor is coupled between the writing circuit and the first transistor. The writing circuit is configured to provide, by a second frequency, a data voltage and a second reference voltage to the storage capacitor and the first transistor, respectively, and the first frequency is different from the second frequency. The storage capacitor is configured to store a first voltage corresponding to the second reference voltage, and the first voltage is used to compensate a threshold voltage of the first transistor.

The disclosure provides a display of low power consumption, which includes a plurality of pixel circuits, a display driving circuit, and one or more shift registers. Each pixel circuit includes a first transistor, a light emitting element, a light emitting control circuit, a reset circuit, a writing circuit, and a storage capacitor. The first transistor is configured to provide a driving current. The light emitting control circuit is coupled between the first transistor and the light emitting element, and is configured to selectively conduct the driving current to the light emitting element. The reset circuit is configured to provide a first reference voltage to the light emitting element by a first frequency. The storage capacitor is coupled between the writing circuit and the first transistor. The writing circuit provides, by a second frequency, a data voltage and a second reference voltage to the storage capacitor and the first transistor, respectively, in which the first frequency is different from the second frequency. The storage capacitor is configured to store a first voltage corresponding to the second reference voltage, and the first voltage is used to compensate a threshold voltage of the first transistor. The display driving circuit is configured to provide the data voltage. The one or more shift registers are configured to provide a plurality of scan signals to drive the plurality of pixel circuits.

It is to be understood that both the foregoing general description and the following detailed description are by examples, and are intended to provide further explanation of the disclosure as claimed.

DETAILED DESCRIPTION

Figure 1:
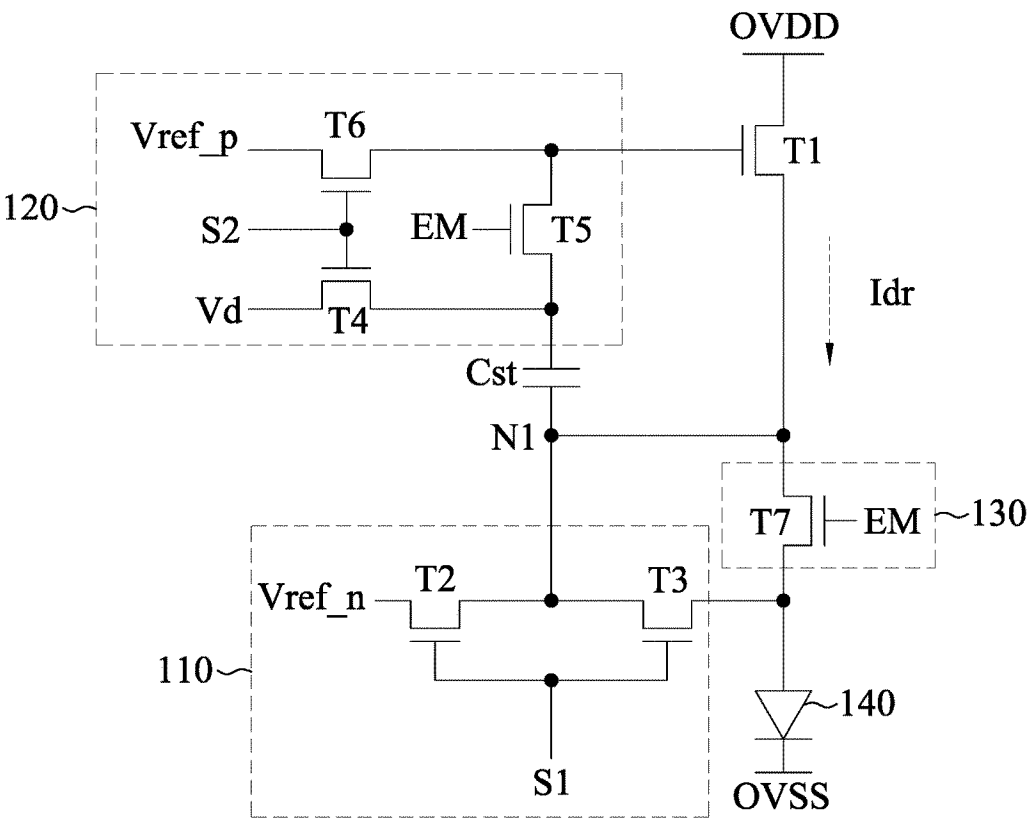
FIG. 1 is a simplified functional block diagram of a pixel circuit according to one embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts.

FIG. 1 is a simplified functional block diagram of a pixel circuit 100 according to one embodiment of the present disclosure. The pixel circuit 100 comprises a first transistor T1, a reset circuit 110, a writing circuit 120, a light emitting control circuit 130, a storage capacitor Cst, and a light emitting element 140. One terminal of the reset circuit 110 is coupled with a first terminal (e.g., an anode) of the light emitting element 140. Through a first node N1, other terminal of the reset circuit 110 is coupled with a first terminal of the storage capacitor Cst and a first terminal of the first transistor T1. The second terminal of the first transistor T1 is configured to receive a first operation voltage OVDD. The second terminal (e.g., a cathode) of the light emitting element 140 is configured to receive a second operation voltage OVSS. One terminal of the writing circuit 120 is coupled with a control terminal of the first transistor T1, while other terminal of the writing circuit 120 is coupled with a second terminal of the storage capacitor Cst. One terminal of the light emitting control circuit 130 is coupled with the first terminal of the first transistor T1 and the first node N1, while other terminal of the light emitting control circuit 130 is coupled with the reset circuit 110 and the first terminal of the light emitting element 140.

The reset circuit 110 is configured to provide, by a first frequency, a first reference voltage Vref_n to the first terminal of the light emitting element 140, so as to reset a voltage of the first terminal of the light emitting element 140. In some embodiments, the reset circuit 110 also provides the first reference voltage Vref_n to the first node N1 by the first frequency to reset a voltage of the first terminal of the first transistor T1. The writing circuit 120 is configured to provide, by a second frequency, the data voltage Vd and the second reference voltage Vref_p to the second terminal of the storage capacitor Cst and the control terminal of the first transistor T1, respectively. The data voltage Vd is for setting the first transistor T1 to provide a driving current Idr having corresponding magnitude. The light emitting control circuit 130 coupled between the first transistor T1 and the light emitting element 140 is configured to selectively conduct the driving current Idr to the light emitting element 140 so that the light emitting element 140 generates corresponding brightness.

The first frequency of the reset circuit 110 may be the same or different from the second frequency of the writing circuit 120. In some embodiments, the first frequency of the reset circuit 110 is greater than the second frequency of the writing circuit 120. For instance, the reset circuit 110 may reset the light emitting element 140 by a frequency of 60 Hz, while the writing circuit 120 may provide the data voltage Vd by merely 1 Hz and thus the pixel circuit 100 is suitable for wearable devices with limited power.

In some embodiments, the first operation voltage OVDD is higher than the second operation voltage OVSS, and the second reference voltage Vref_p is higher than the first reference voltage Vref_n. In other embodiments, the light emitting element 140 may be implemented by an organic light-emitting diode (OLED) or a micro LED. In yet some embodiments, the transistors of the pixel circuit 100 are all N-type transistors.

Reference is made to FIG. 1 again. The reset circuit 110 comprises a second transistor T2 and a third transistor T3, in which the second transistor T2 and the third transistor T3 each have a first terminal, a second terminal, and a control terminal. The first terminal of the second transistor T2 is coupled with the first node N1, and the second terminal of the second transistor T2 is configured to receive the first reference voltage Vref_n. The first terminal of the third transistor T3 is coupled with the first terminal of the light emitting element 140, and the second terminal of the third transistor T3 is coupled with the first node N1. The control terminals of the second transistor T2 and the third transistor T3 are together configured to receive a first scan signal S1.

The writing circuit 120 comprises a fourth transistor T4, a fifth transistor T5, and a sixth transistor T6, in which the fourth transistor T4, the fifth transistor T5, and the sixth transistor T6 each comprise a first terminal, a second terminal, and a control terminal. The first terminal of the fourth transistor T4 is coupled with the second terminal of the storage capacitor Cst, and the second terminal of the fourth transistor T4 is configured to receive the data voltage Vd. The first terminal of the fifth transistor T5 is coupled with the control terminal of the first transistor T1, and the second terminal of the fifth transistor T5 is coupled with the second terminal of the storage capacitor Cst. The first terminal of the sixth transistor T6 is coupled with the control terminal of the first transistor T1, and the second terminal of the sixth transistor T6 is configured to receive the second reference voltage Vref_p. The control terminals of the fourth transistor T4 and the sixth transistor T6 are together configured to receive a second scan signal S2, and the control terminal of the fifth transistor T5 is configured to receive a light emitting control signal EM.

The light emitting control circuit 130 comprises a seventh transistor T7. The seventh transistor T7 is coupled between the first terminal of the first transistor T1 and the first terminal of the light emitting element 140, and a control terminal of the seventh transistor T7 is configured to receive the light emitting control signal EM.

Figure 2:
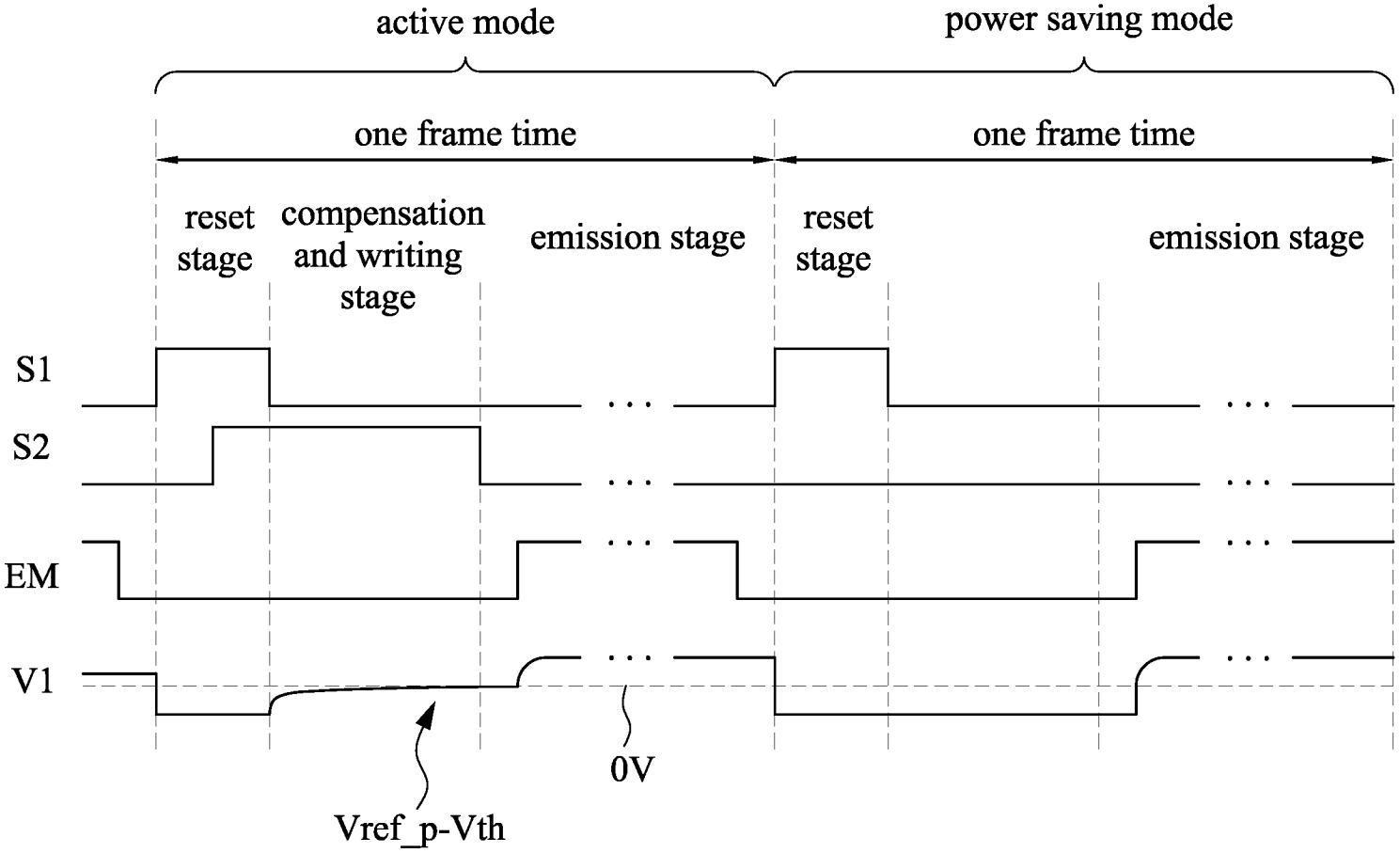
FIG. 2 is a waveform schematic diagram of control signals and node voltages of the pixel circuit of FIG. 1.

FIG. 2 is a waveform schematic diagram of control signals and node voltages of the pixel circuit 100. As shown in FIG. 2, by changing waveforms of the control signals of the pixel circuit 100, the pixel circuit 100 may be switched between an active mode and a power saving mode. The lasting time length of each of the active mode and the power saving mode is substantially equal one frame period. The active mode is for updating the data voltage Vd stored in the pixel circuit 100 and thus the brightness of the pixel circuit 100 is changed, while the power saving mode is for resetting the node voltages of the pixel circuit 100 to keep the brightness in stable. The pixel circuit 100 may successively enter the power saving mode a plurality of times after executing the active mode for one time. For example, the pixel circuit 100 mitigates power consumption by entering the active mode for one (1) time and then successively entering the power saving mode for fifty-nine (59) times.

Figure 3A:
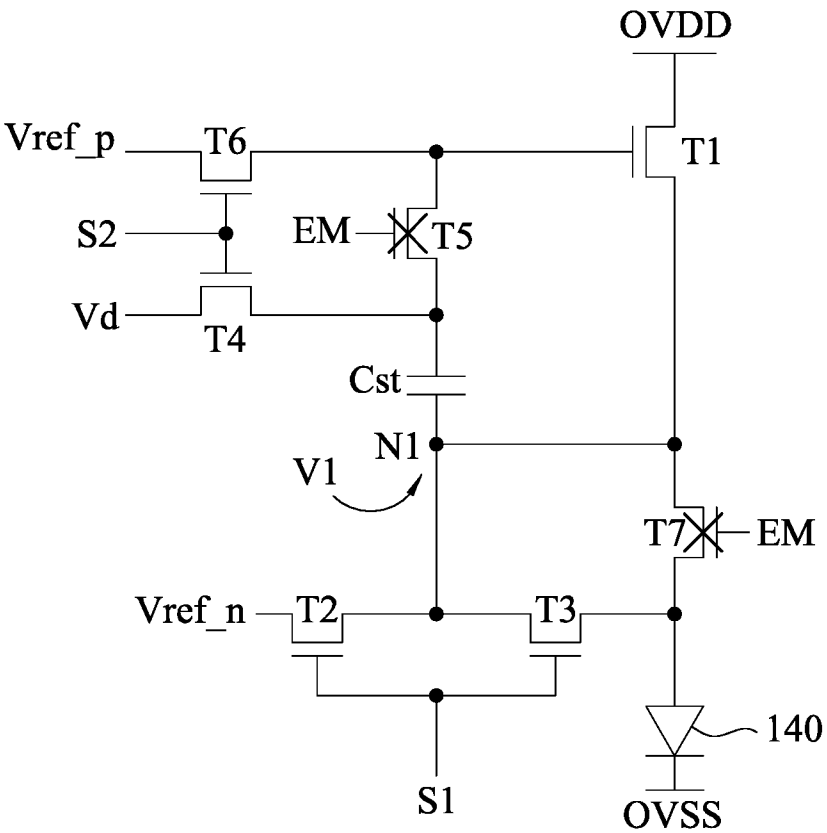
FIG. 3A is a schematic diagram for illustrating an equivalent circuit operation of the pixel circuit of FIG. 1 in a reset stage of an active mode.

In specific, the active mode comprises a reset stage, a compensation and writing stage, and an emission stage. Reference is made to FIG. 2 and FIG. 3A. In the reset stage of the active mode, the first scan signal S1 and the second scan signal S2 having a logic high level, such as a high voltage capable of conducting N-type transistors. The light emitting control signal EM has a logic low level, such as a low voltage capable of switching off N-type transistors. In this case, the fifth transistor T5 and the seventh transistor T7 are switched off, while other transistors of the pixel circuit 100 are conducted. The reset circuit 110 transmits the first reference voltage Vref_n to the first terminal of the light emitting element 140 and the first node N1. The writing circuit 120 transmits the data voltage Vd and the second reference voltage Vref_p respectively to the second terminal of the storage capacitor Cst and the control terminal of the first transistor T1. For explanation convenience, the voltage of the first node N1 is hereinafter referred to as a "first voltage V1."

Figure 3B:
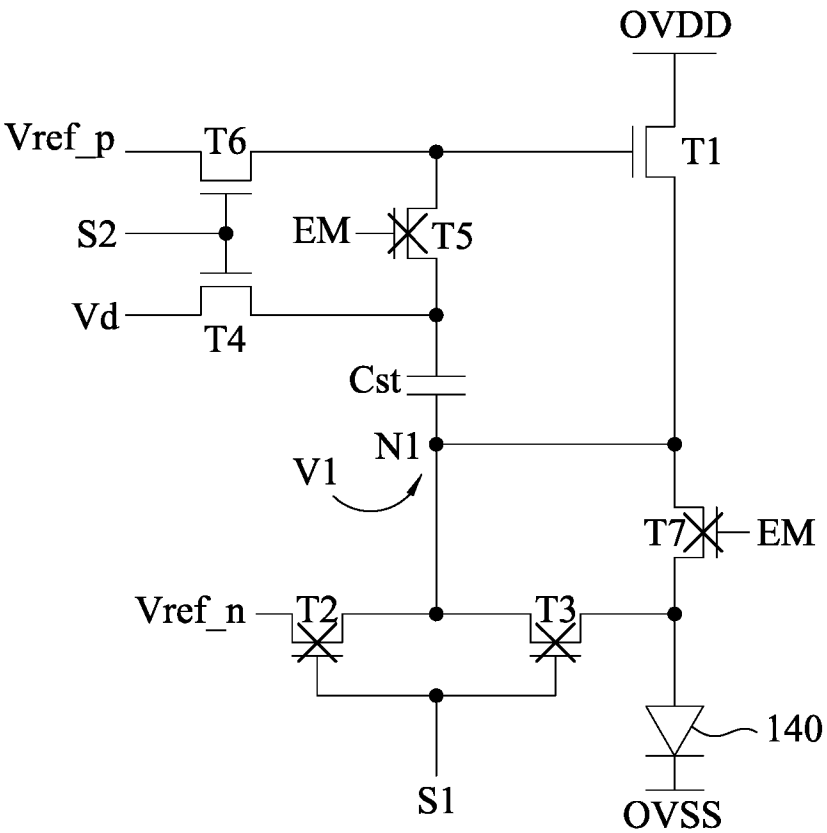
FIG. 3B is a schematic diagram for illustrating an equivalent circuit operation of the pixel circuit of FIG. 1 in a compensation and writing stage of the active mode.

Next, reference is made to FIG. 2 and FIG. 3B. In the compensation and writing stage, the first scan signal S1 and the light emitting control signal EM have the logic low level, and the second scan signal S2 has the logic high level. Therefore, the first transistor T1, the fourth transistor T4, and the sixth transistor T6 are conducted, while other transistors of the pixel circuit 100 are switched off. Since the writing circuit 120 keeps providing the second reference voltage Vref_p to the control terminal of the first transistor T1, the first voltage V1 of the compensation and writing stage can be substantially described by the following Formula 1, in which the symbol "Vth" represents a threshold voltage of the first transistor T1.

$$V1=V\text{ref_}p-Vth \quad \text{Formula 1}$$

Figure 3C:
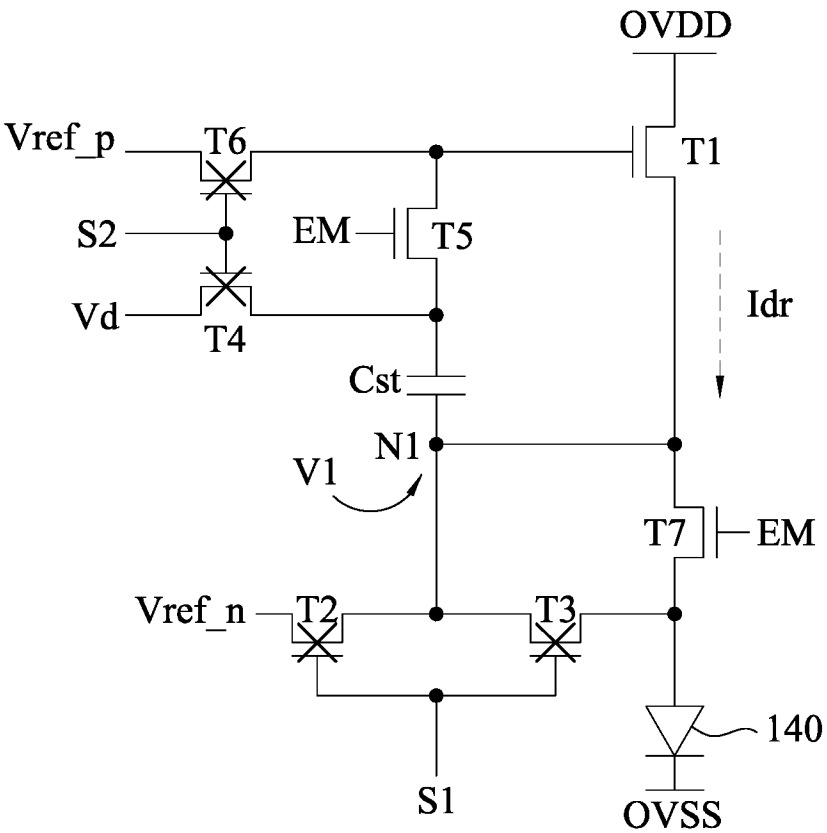
FIG. 3C is a schematic diagram for illustrating an equivalent circuit operation of the pixel circuit of FIG. 1 in an emission stage of the active mode.

Reference is made to FIG. 2 and FIG. 3C, in the emission stage of the active mode, the first scan signal S1 and the second scan signal S2 have the logic low level, while the light emitting control signal EM has the logic high level. Therefore, the first transistor T1, the fifth transistor T5, and the seventh transistor T7 are conducted, while other transistors of the pixel circuit 100 are switched off. In this situation, the data voltage Vd stored at the second terminal of the storage capacitor Cst is provided to the control terminal of the first transistor T1. Since the storage capacitor Cst is far greater than a capacitor of the control terminal of the first transistor T1, the voltage of the control terminal of the first transistor T1 is substantially changed to the data voltage Vd. Therefore, the first transistor T1 provides the driving current Idr which can be described by the following Formula 2.

$$Idr=k[Vd-(V\text{ref_}p-Vth)-Vth]^2=k(Vd-V\text{ref_}p)^2 \quad \text{Formula 2}$$

In some embodiments, the symbol "k" in Formula 2 is a product of the carrier mobility, the gate oxide capacitance per unit area, and the width-to-length ratio of the first transistor T1. According to Formula 1 and Formula 2, the first voltage V1 can be used to compensate a variation of the threshold voltage of the first transistor T1, thereby mitigating effects to the driving current Idr caused by characteristic variations of the first transistor T1. In addition, Formula 2 shows that when degradation of the light emitting element 140 causes a rising to a cross voltage thereof, the magnitude of the driving current Idr is barely affected. Accordingly, the pixel circuit 100 is suitable for providing brightness that is stable and predictable, so as to display pictures of high quality.

Figure 3D:
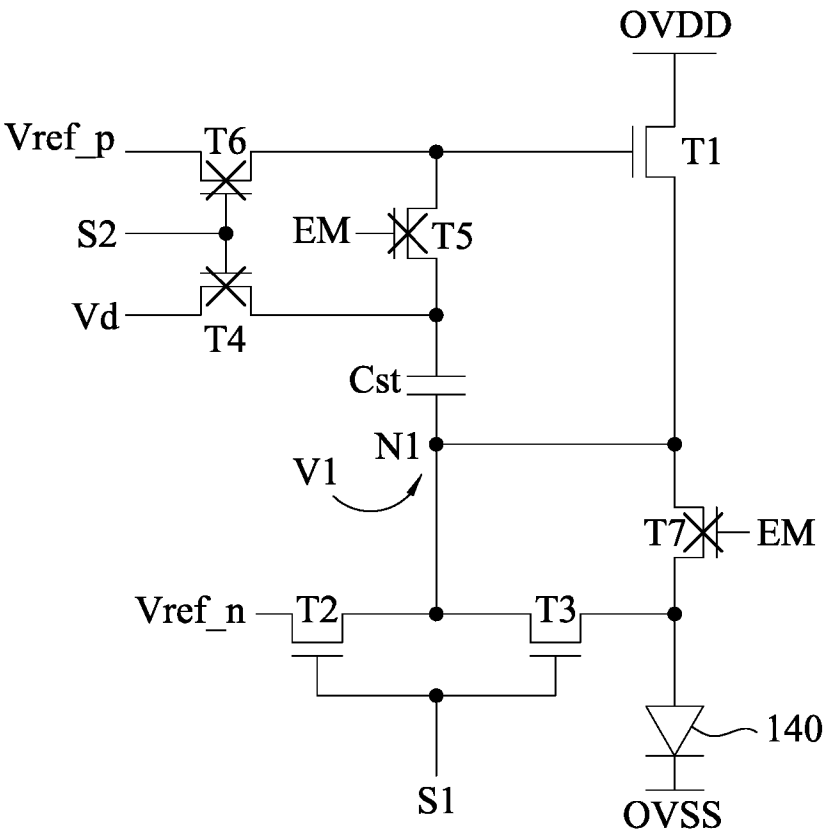
FIG. 3D is a schematic diagram for illustrating an equivalent circuit operation of the pixel circuit of FIG. 1 in a reset stage of a power saving mode.

Referring to FIG. 2 again, the power saving mode comprises the reset stage and the emission stage. In the reset stage of the power saving mode, only the first scan signal S1 has the logic high level, while the second scan signal S2 and the light emitting control signal EM have the logic low level. Therefore, as shown in FIG. 3D, the reset circuit 110 resets the voltage of the first terminal of the light emitting element 140 to stabilize the emission characteristic of the light emitting element 140.

The emission stage of the power saving mode is similar to that of the active mode, and thus those descriptions are omitted here for the sake of brevity. Notably, since the second terminal of the storage capacitor Cst is floating during the power saving mode, the cross voltage of the storage capacitor Cst in the whole power saving mode and the cross voltage of the storage capacitor Cst in the emission stage of the active mode are substantially the same. Therefore, in the emission stages of both the power saving mode and the active mode, the pixel circuit 100 provides the driving current Idr substantially the same.

Under normal use, a display of a wearable device changes display images thereof by a significantly low frequency (e.g., 1 Hz). Therefore, when the pixel circuit 100 is applied to the display of the wearable device, the wearable device may reduce the number of times to output the data voltage Vd by driving the pixel circuit 100 in the active mode for one time and then successively in the power saving mode for multiple times, thereby extending battery life time of the wearable device.

Figure 4:
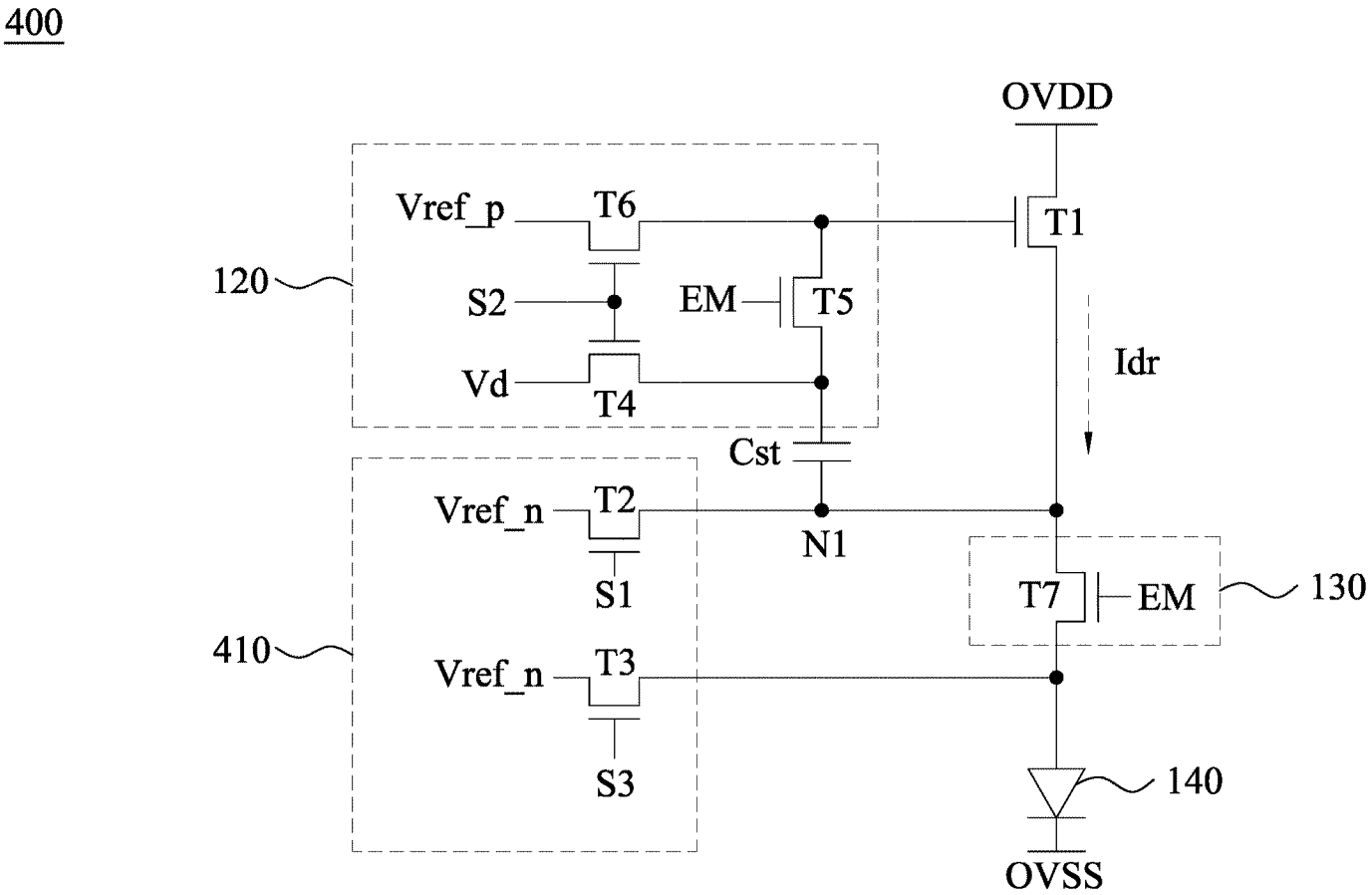
FIG. 4 is a simplified functional block diagram of a pixel circuit according to one embodiment of the present disclosure.

FIG. 4 is a simplified functional block diagram of a pixel circuit 400 according to one embodiment of the present disclosure. The pixel circuit 400 comprises a first transistor T1, a reset circuit 410, a writing circuit 120, a light emitting control circuit 130, a storage capacitor Cst, and a light emitting element 140. The reset circuit 410 is configured to provide the first reference voltage Vref_n to the first terminal of the light emitting element 140 by the first frequency, so as to reset the voltage of the first terminal of the light emitting element 140. The writing circuit 120 is configured to provide, by the second frequency, the data voltage Vd and the second reference voltage Vref_p to the second terminal of the storage capacitor Cst and the control terminal of the first transistor T1, respectively. The first frequency of the reset circuit 410 may be the same or different from the second frequency of the writing circuit 120. In some embodiments, the first frequency of the reset circuit 410 is greater than the second frequency of the writing circuit 120.

In this embodiment, the reset circuit 410 comprises a second transistor T2 and a third transistor T3, in which the second transistor T2 and the third transistor T3 each have a first terminal, a second terminal, and a control terminal. Through the first node N1, the first terminal of the second transistor T2 is coupled with the storage capacitor Cst, the first terminal of the first transistor T1, and the light emitting control circuit 130. The second terminal of the second transistor T2 is configured to receive the first reference voltage Vref_n. The control terminal of the second transistor T2 is configured to receive the first scan signal S1. The first terminal of the third transistor T3 is coupled with the light emitting element 140. The second terminal of the third transistor T3 is configured to receive the first reference voltage Vref_n. the control terminal of the third transistor T3 is configured to receive the third scan signal S3. The foregoing descriptions regarding to other corresponding implementations, connections, operations, and related advantages of the pixel circuit 100 are also applicable to the pixel circuit 100. For the sake of brevity, those descriptions will not be repeated here.

Figure 5:
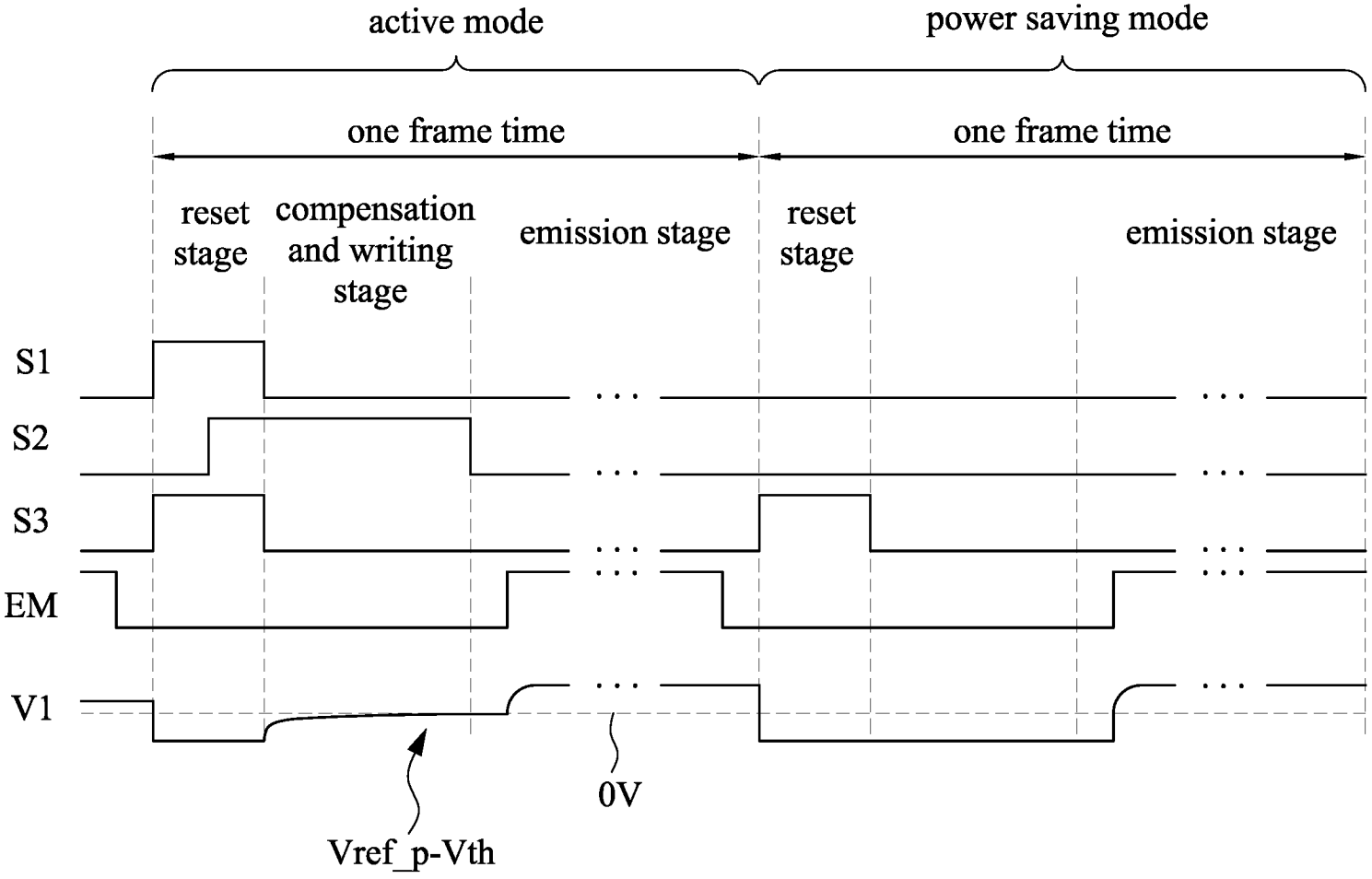
FIG. 5 is a waveform schematic diagram of the control signals and the node voltages of the pixel circuit of FIG. 4.

FIG. 5 is a waveform schematic diagram of the control signals and the node voltages of the pixel circuit 400. As can be known from FIG. 5, the active mode of the pixel circuit 400 is similar to that of the pixel circuit 100, and thus those descriptions will not be repeated here for the sake of brevity.

In the reset stage of the pixel circuit 400, the first scan signal S1, the second scan signal S2, and the light emitting control signal EM have logic low level, while the third scan signal S3 has the logic high level. Therefore, the first transistor T1 and the third transistor T3 are conducted, and other transistors of the pixel circuit 400 are switched off. In this case, the reset circuit 410 resets the voltage of the first terminal of the light emitting element 140 to stabilize the emission characteristic of the light emitting element 140. It is worth mentioning that, the cross voltage of the storage capacitor Cst in the power saving mode and the cross voltage of the storage capacitor Cst in the emission stage of the active mode are substantially the same. Therefore, in the emission stages of both the power saving mode and the active mode, the pixel circuit 400 provides the driving current Idr substantially the same.

In the reset stage of the power saving mode of the pixel circuit 400, no current path exists between the first operation voltage OVDD and the first reference voltage Vref_n, and thus the first terminal of the first transistor T1 can keep the voltage in stable to mitigate the image flicker, while the power consumption of the pixel circuit 400 is therefore further reduced.

Figure 6:
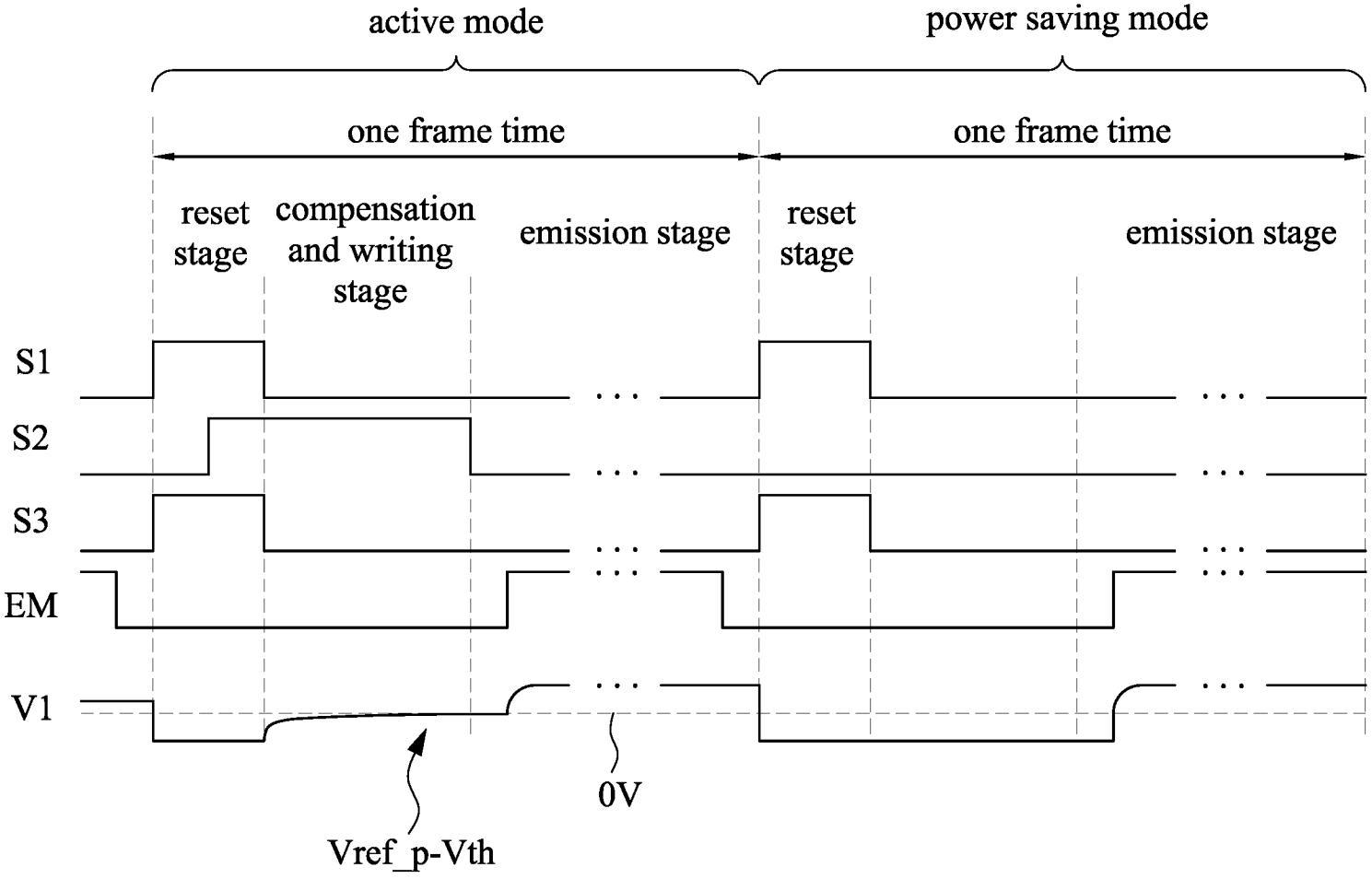
FIG. 6 is another waveform schematic diagram of the control signals and the node voltages of the pixel circuit of FIG. 4.

In some embodiments, the control signals provided to the pixel circuit 400 have waveforms shown in FIG. 6, that is, the first scan signal S1 and the third scan signal S3 have logic high level in the reset stage of the power saving mode. In this situation, since the first scan signal S1 and the third scan signal S3 have the same waveform, the first scan signal S1 and the third scan signal S3 may be the same signal from the same wire to reduce the circuit area of the pixel circuit 400.

Figure 7:
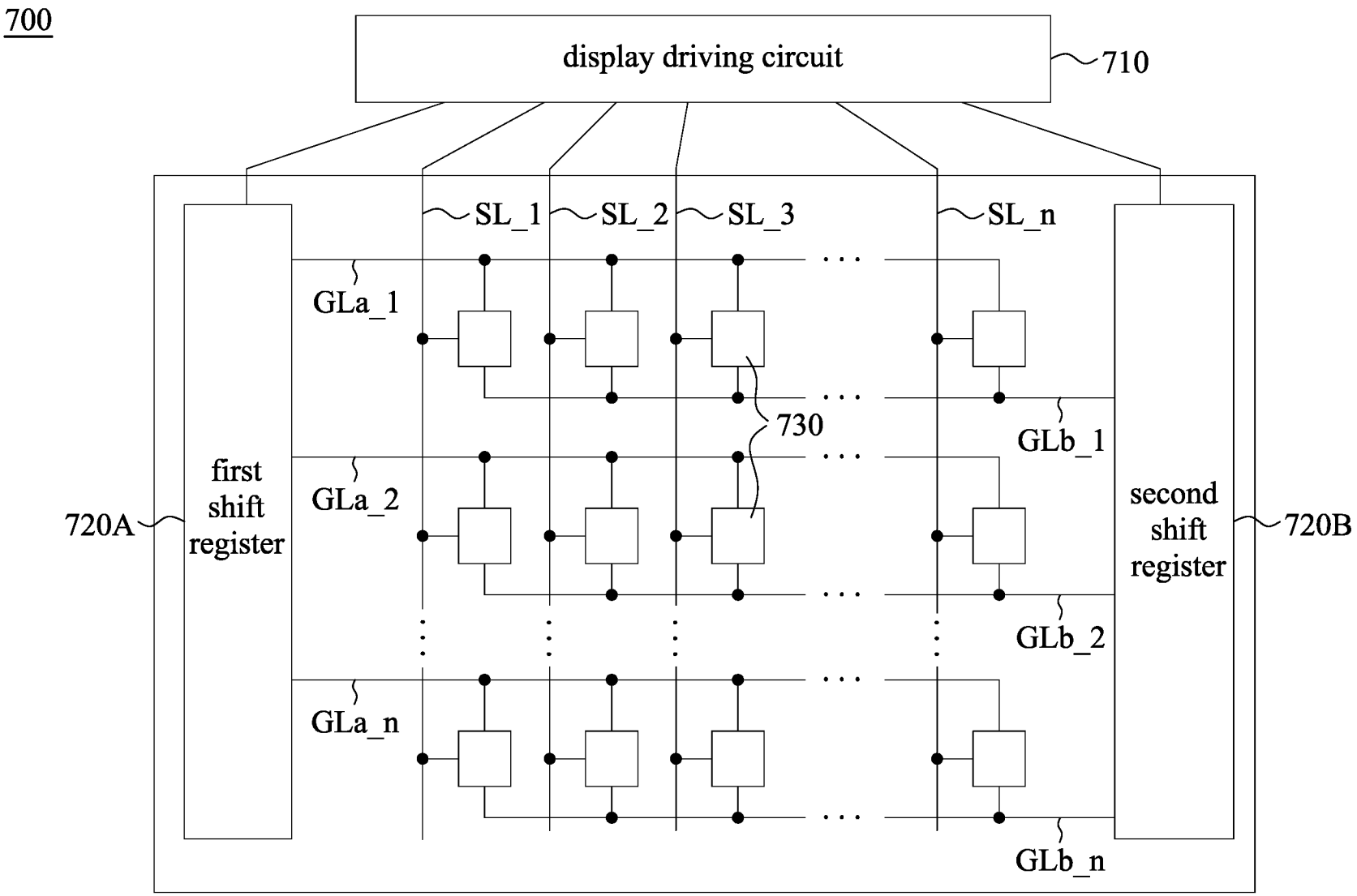
FIG. 7 is a simplified functional block diagram of a display according to one embodiment of the present disclosure.

FIG. 7 is a simplified functional block diagram of a display 700 according to one embodiment of the present disclosure. The display 700 comprises a display driving circuit 710, a first shift register 720A, a second shift register 720B, and a plurality of pixel circuits 730, in which the pixel circuits 730 may be implemented by the aforementioned pixel circuit 100 or 400. The display driving circuit 710 is configured to provide the data voltage Vd to the pixel circuits 730 through a plurality of data lines SL_1-SL_n, and is configured to provide a plurality of clock signals to the first shift register 720A and the second shift register 720B.

In one embodiment, the display driving circuit 710 may be implemented by the display driver IC (DDIC). In another embodiment, the display driving circuit 710 is realized by a combination of different circuit blocks, such as a combination of the timing controller and the source driver.

In some embodiments, the first shift register 720A is configured to provide the aforesaid first scan signal S1, second scan signal S2, and third scan signal S3 to a plurality of scan lines GLa_1-GLa_n in sequence to drive rows of pixel circuit 730 in sequence in the aforesaid active mode or power saving mode. If the pixel circuit 730 is realized by the pixel circuit 100, the first shift register 720A can provide only the first scan signal S1 and the second scan signal S2. The second shift register 720B is configured to provide the aforesaid light emitting control signal EM to the scan lines GLb_1-GLb_n in sequence to light up the rows of pixel circuit 730 in sequence. The pixel circuits 730 are correspondingly disposed near the intersections of the data lines SL_1-SL_n and the scan lines GLa_1-GLa_n, or near the intersections of the data lines SL_1-SL_n and the scan lines GLb_1-GLb_n.

Notably, a shift register may provide signals of one category, or provide signals of multiple categories in the same time. Therefore, the display 700 is not limited to the embodiment of having two shift registers. In some embodiments, the display 700 may comprise one or more shift registers according to practical design requirements, in which these shift registers are configured to provide the first scan signal S1, the second scan signal S2, the third scan signal S3, and the light emitting control signal EM. If the pixel circuit 730 is realized by the pixel circuit 100, the one or more shift registers may be arranged as not providing the third scan signal S3.

As can be appreciated from the above, the display 700 is capable of switching the pixel circuit 730 between the active mode and the power saving mode, resulting that the display 700 can provide the data voltage Vd to a plurality of pixel circuits 730 in a significantly low frequency (e.g., 1 Hz). Therefore, the display 700 is suitable for a wearable device having limited power.

In some embodiments, the writing circuit 120 of the pixel circuits 100 and 400 may be fabricated by oxide transistors, that is, the writing circuit 120 comprises oxide transistors, such as the indium gallium zinc oxide thin-film transistor (IGZO TFT). In specific, the fourth transistor T4, the fifth transistor T5, and the sixth transistor T6 of the writing circuit 120 are oxide transistors. In this situation, other functional blocks and components of the pixel circuits 100 and 400 may be fabricated by the low temperature poly-silicon (LIPS) transistors. Specifically, the first transistor T1, the second transistor T2, the third transistor T3, and the seventh transistor T7 in FIG. 1 and FIG. 4 may be LTPS transistors.

As a result, because of the advantage of low leakage currents of the oxide transistors, the oxide transistors of the writing circuit 120 are helpful to stabilize voltage of each node of the writing circuit 120 in the power saving mode. In addition, the advantage of high carrier mobility of the LTPS transistors is helpful to increase the highest brightness of the pixel circuits 100 and 400, and is also helpful to completely reset voltage of each node.

In some embodiments, for simplifying the fabrication process of the pixel circuits 100 and 400, transistors of the pixel circuits 100 and 400 are all oxide transistors or LTPS transistors.

In some embodiments, one of the oxide transistor and the LTPS transistor can be selected to implement a transistor of the pixel circuits 100 and 400 as will be apparent to those of ordinary skill in the art in view of the teachings herein.

It is worth mentioning that in some embodiments that the power saving is not considered to be a priority, the pixel circuits 100 and 400 can repeatedly enter the active mode without entering the power saving mode. That is, the first frequency the reset circuit 110 or 410 provides the first reference voltage Vref_n may be the same as the second frequency the writing circuit 120 provides the data voltage Vd.

Certain terms are used throughout the description and the claims to refer to particular components. One skilled in the art appreciates that a component may be referred to as different names. This disclosure does not intend to distinguish between components that differ in name but not in function. In the description and in the claims, the term "comprise" is used in an open-ended fashion, and thus should be interpreted to mean "include, but not limited to." The term "couple" is intended to compass any indirect or direct connection. Accordingly, if this disclosure mentioned that a first device is coupled with a second device, it means that the first device may be directly or indirectly connected to the second device through electrical connections, wireless communications, optical communications, or other signal connections with/without other intermediate devices or connection means.

The term "and/or" may comprise any and all combinations of one or more of the associated listed items. In addition, the singular forms "a," "an," and "the" herein are intended to comprise the plural forms as well, unless the context clearly indicates otherwise.

Other embodiments of the present disclosure will be apparent to those skilled in the art from consideration of the specification and practice of the present disclosure disclosed herein. It is intended that the specification and examples be considered as exemplary only, with a true scope and spirit of the present disclosure being indicated by the following claims.

What is claimed is:

1. A pixel circuit of low power consumption, comprising:

a first transistor, configured to provide a driving current;

a light emitting element;

a light emitting control circuit, coupled between the first transistor and the light emitting element, and configured to selectively conduct the driving current to the light emitting element;

a reset circuit, configured to provide a first reference voltage to the light emitting element by a first frequency;

a writing circuit; and a storage capacitor, coupled between the writing circuit and the first transistor, wherein the writing circuit is configured to provide, by a second frequency, a data voltage and a second reference voltage to the storage capacitor and the first transistor, respectively, and the first frequency is different from the second frequency;

wherein the storage capacitor is configured to store a first voltage corresponding to the second reference voltage, and the first voltage is used to compensate a threshold voltage of the first transistor.

2. The pixel circuit of claim 1, wherein the first frequency is greater than the second frequency.

3. The pixel circuit of claim 1, wherein the reset circuit comprises:

a second transistor, comprising a first terminal, a second terminal, and a control terminal, wherein the first terminal of the second transistor is coupled with a first node, and the second terminal of the second transistor is configured to receive the first reference voltage; and a third transistor, comprising a first terminal, a second terminal, and a control terminal, wherein the first terminal of the third transistor is coupled with the light emitting element, and the second terminal of the third transistor is coupled with the first node;

wherein the control terminal of the second transistor and the control terminal of the third transistor are configured to receive a first scan signal, and the first node is coupled with the storage capacitor, the first transistor, and the light emitting control circuit.

4. The pixel circuit of claim 1, wherein the writing circuit comprises:

a fourth transistor, comprising a first terminal, a second terminal, and a control terminal, wherein the first terminal of the fourth transistor is coupled with the storage capacitor, the second terminal of the fourth transistor is configured to receive the data voltage, and the control terminal of the fourth transistor is configured to receive a second scan signal;

a fifth transistor, comprising a first terminal, a second terminal, and a control terminal, wherein the first terminal of the fifth transistor is coupled with the first transistor, the second terminal of the fifth transistor is coupled with the storage capacitor, and the control terminal of the fifth transistor is configured to receive a light emitting control signal; and a sixth transistor, comprising a first terminal, a second terminal, and a control terminal, wherein the first terminal of the sixth transistor is coupled with the first transistor, the second terminal of the sixth transistor is configured to receive the second reference voltage, and the control terminal of the sixth transistor is configured to receive the second scan signal.

5. The pixel circuit of claim 4, wherein the fourth transistor, the fifth transistor, and the sixth transistor are oxide transistors, and the first transistor is a low-temperature poly-silicon (LTPS) transistor, wherein the reset circuit and the light emitting control circuit comprise a plurality of LTPS transistors different from the first transistor.

6. The pixel circuit of claim 1, wherein the reset circuit comprises:

a second transistor, comprising a first terminal, a second terminal, and a control terminal, wherein the first terminal of the second transistor is coupled with the storage capacitor, the first transistor, and the light emitting control circuit through a first node, the second terminal of the second transistor is configured to receive the first reference voltage, and the control terminal of the second transistor is configured to receive a first scan signal; and a third transistor, comprising a first terminal, a second terminal, and a control terminal, wherein the first terminal of the third transistor is coupled with the light emitting element, the second terminal of the third transistor is configured to receive the first reference voltage, and the control terminal of the third transistor is configured to receive a third scan signal.

7. The pixel circuit of claim 6, wherein the first scan signal and the third scan signal have a same waveform.

8. The pixel circuit of claim 1, wherein the light emitting control circuit comprises a seventh transistor coupled between the first transistor and the light emitting element, and a control terminal of the seventh transistor is configured to receive a light emitting control signal.

9. The pixel circuit of claim 1, wherein the writing circuit comprises a plurality of oxide transistors, and the first transistor is a LTPS transistor, wherein the reset circuit and the light emitting control circuit comprise a plurality of LTPS transistors different from the first transistor.

10. A display of low power consumption, comprising:

a plurality of pixel circuits, wherein each pixel circuit comprises:

a first transistor, configured to provide a driving current;

a light emitting element;

a light emitting control circuit, coupled between the first transistor and the light emitting element, and configured to selectively conduct the driving current to the light emitting element;

a reset circuit, configured to provide a first reference voltage to the light emitting element by a first frequency;

a writing circuit; and a storage capacitor, coupled between the writing circuit and the first transistor, wherein the writing circuit provides, by a second frequency, a data voltage and a second reference voltage to the storage capacitor and the first transistor, respectively, and the first frequency is different from the second frequency, wherein the storage capacitor is configured to store a first voltage corresponding to the second reference voltage, and the first voltage is used to compensate a threshold voltage of the first transistor;

a display driving circuit, configured to provide the data voltage; and one or more shift registers, configured to provide a plurality of scan signals to drive the plurality of pixel circuits.

11. The display of claim 10, wherein the first frequency is greater than the second frequency.

12. The display of claim 10, wherein the reset circuit comprises:

a second transistor, comprising a first terminal, a second terminal, and a control terminal, wherein the first terminal of the second transistor is coupled with a first node, the second terminal of the second transistor is configured to receive the first reference voltage; and a third transistor, comprising a first terminal, a second terminal, and a control terminal, wherein the first terminal of the third transistor is coupled with the light emitting element, and the second terminal of the third transistor is coupled with the first node;

wherein the control terminal of the second transistor and the control terminal of the third transistor are configured to receive a first scan signal of the plurality of scan signals, and the first node is coupled with the storage capacitor, the first transistor, and the light emitting control circuit.

13. The display of claim 10, wherein the writing circuit comprises:

a fourth transistor, comprising a first terminal, a second terminal, and a control terminal, wherein the first terminal of the fourth transistor is coupled with the storage capacitor, the second terminal of the fourth transistor is configured to receive the data voltage, and the control terminal of the fourth transistor is configured to receive a second scan signal of the plurality of scan signals;

a fifth transistor, comprising a first terminal, a second terminal, and a control terminal, wherein the first terminal of the fifth transistor is coupled with the first transistor, the second terminal of the fifth transistor is coupled with the storage capacitor, and the control terminal of the fifth transistor is configured to receive a light emitting control signal of the plurality of scan signals; and a sixth transistor, comprising a first terminal, a second terminal, and a control terminal, wherein the first terminal of the sixth transistor is coupled with the first transistor, the second terminal of the sixth transistor is configured to receive the second reference voltage, and the control terminal of the sixth transistor is configured to receive the second scan signal.

14. The display of claim 13, wherein the fourth transistor, the fifth transistor, and the sixth transistor are oxide transistors, and the first transistor is a LTPS transistor, wherein the reset circuit and the light emitting control circuit comprise a plurality of LTPS transistors different from the first transistor.

15. The display of claim 10, wherein the reset circuit comprises:

a second transistor, comprising a first terminal, a second terminal, and a control terminal, wherein the first terminal of the second transistor is coupled with the storage capacitor, the first transistor, and the light emitting control circuit through a first node, the second terminal of the second transistor is configured to receive the first reference voltage, and the control terminal of the second transistor is configured to receive a first scan signal of the plurality of scan signals; and a third transistor, comprising a first terminal, a second terminal, and a control terminal, wherein the first terminal of the third transistor is coupled with the light emitting element, the second terminal of the third transistor is configured to receive the first reference voltage, and the control terminal of the third transistor is configured to receive a third scan signal of the plurality of scan signals.

16. The display of claim 15, wherein the first scan signal and the third scan signal have a same waveform.

17. The display of claim 10, wherein the light emitting control circuit comprises a seventh transistor coupled between the first transistor and the light emitting element, and a control terminal of the seventh transistor is configured to receive a light emitting control signal of the plurality of scan signals.

18. The display of claim 10, wherein the writing circuit comprises a plurality of oxide transistors, and the first transistor is a LTPS transistor, wherein the reset circuit and the light emitting control circuit comprise a plurality of LTPS transistors different from the first transistor.

* * * * *